US005664726A

United States Patent [19]

Opper

[11] Patent Number: 5,664,726

[45] Date of Patent: Sep. 9, 1997

[54] COLLAPSIBLE BOX CONSTRUCTION

[75] Inventor: Tom S. Opper, Belmont, Mich.

[73] Assignee: DeWitt Packaging Corp., Grand Rapids, Mich.

[21] Appl. No.: 705,740

[22] Filed: Aug. 30, 1996

[51] Int. Cl.[6] ..... B65D 5/36

[52] U.S. Cl. ..... 229/117; 229/185

[58] Field of Search ..... 229/117, 117.03, 229/155, 185

[56] References Cited

U.S. PATENT DOCUMENTS

| | | | |
|---|---|---|---|
| 1,720,146 | 7/1929 | Reese | 229/185 |
| 2,538,860 | 1/1951 | Buttery | 229/117 |
| 3,178,096 | 4/1965 | Reeves et al. | 229/117 |
| 3,790,064 | 2/1974 | Kramer . | |
| 3,960,313 | 6/1976 | Sax et al. . | |
| 4,040,560 | 8/1977 | Grossman et al. | 229/117 |
| 4,354,630 | 10/1982 | Roccaforte . | |
| 4,583,678 | 4/1986 | Weimer, Jr. | 229/117 |
| 5,145,110 | 9/1992 | Terpstra . | |

*Primary Examiner*—Gary E. Elkins

*Attorney, Agent, or Firm*—Varnum, Riddering, Schmidt & Howlett LLP

[57] ABSTRACT

A collapsible box construction in which a flat blank, made of a suitably rigid material, is assembled to form a box. The box construction can be assembled and stored in a flat configuration and thereafter erected into the box in a simple, efficient manner. Additionally, the initial assembly of the blank into the box construction provides stability and rigidity without requiring that one or more bottom flaps be glued or otherwise fixedly mounted together.

8 Claims, 4 Drawing Sheets

COLLAPSIBLE BOX CONSTRUCTION

BACKGROUND OF THE INVENTION

1. Field of the Invention

This invention relates to a collapsible box for carrying various articles, and more specifically, to a collapsible box having interlocking bottom flaps which do not require a gluing step during manufacture.

2. Description of the Prior Art

The prior art includes collapsible box assemblies which may be expanded from a folded position into an expanded position in which the rectangular box has four vertical walls defining an interior chamber of the box and floor flaps which interlock to form a rigid floor. To manufacture a box of this type, a paper stock material must be cut into a "blank" which is essentially an individual flat piece of the paper stock which has been specially shaped and scored to define the walls, floor flaps and the axes along which the blank must be folded during assembly. Once the blank has been properly folded, the floor flaps are glued together to ensure that the flaps will not separate during use of the box.

The gluing of the floor flaps requires extra time and expense during the manufacture of the box blank and it would be desirable to produce a collapsible box of this type which does not require a gluing step for the floor flaps.

SUMMARY OF THE INVENTION

The foregoing problems are solved by the present invention wherein a blank is adapted to form a rectangular box with an interlocked base. The blank comprises four side panels hinged together in series with a panel at one end of the series having a side flap for mounting to a panel at the opposite end of the series. All of the side panels share a common edge. Each of four bottom panels is hinged to a corresponding side panel along the common edge. The four bottom panels comprise two first bottom panels and two second bottom panels which are disposed in an alternating arrangement. Each of the first bottom panels has a bottom flap which includes a corner adjacent to a second bottom panel, and a tab on the flap. A notch extends inwardly from an outer edge of each of the first bottom panels. Each of the second bottom panels has an outer edge and a slot adjacent to and extending away from the common edge. The slot is adapted to lockingly receive the tab on the adjacent first bottom panel.

With this construction, when the side flap is mounted to the panel at the opposite end of the series and the tab on each of the first bottom panels is received with within the slot on the adjacent second bottom panels, the blank forms a box which is selectively movable between a collapsed position and an erected position. In the flap position, the bottom panels are folded inwardly between two series of side panels in a flat arrangement, and in the erected position, the outer edge of each second bottom panel is received in a notch for form an interlocked base.

Preferably, the notch in each of the first bottom panels is V-shaped and the four side panels are of equal shape and size. Also, the bottom flap of each of the first bottom panels would preferably be in the overall general shape of a triangle with one edge of the triangle being a hinged connection with the remaining portion of the panel.

In one aspect of the invention, the tab on each of the first bottom panels and a slot on each of the second bottom panels will include locking means to secure the engagement between them. Preferably, the locking means on a tab comprises at least one slot which extends inwardly from the bottom flap. Similarly, the locking means on the slot comprises a slit disposed at each terminal end of the slot extending in an obtuse angle.

BRIEF DESCRIPTION OF THE DRAWINGS

The invention will now be described with reference to the drawings in which.

DETAILED DESCRIPTION OF THE PREFERRED EMBODIMENTS

Figure 1:
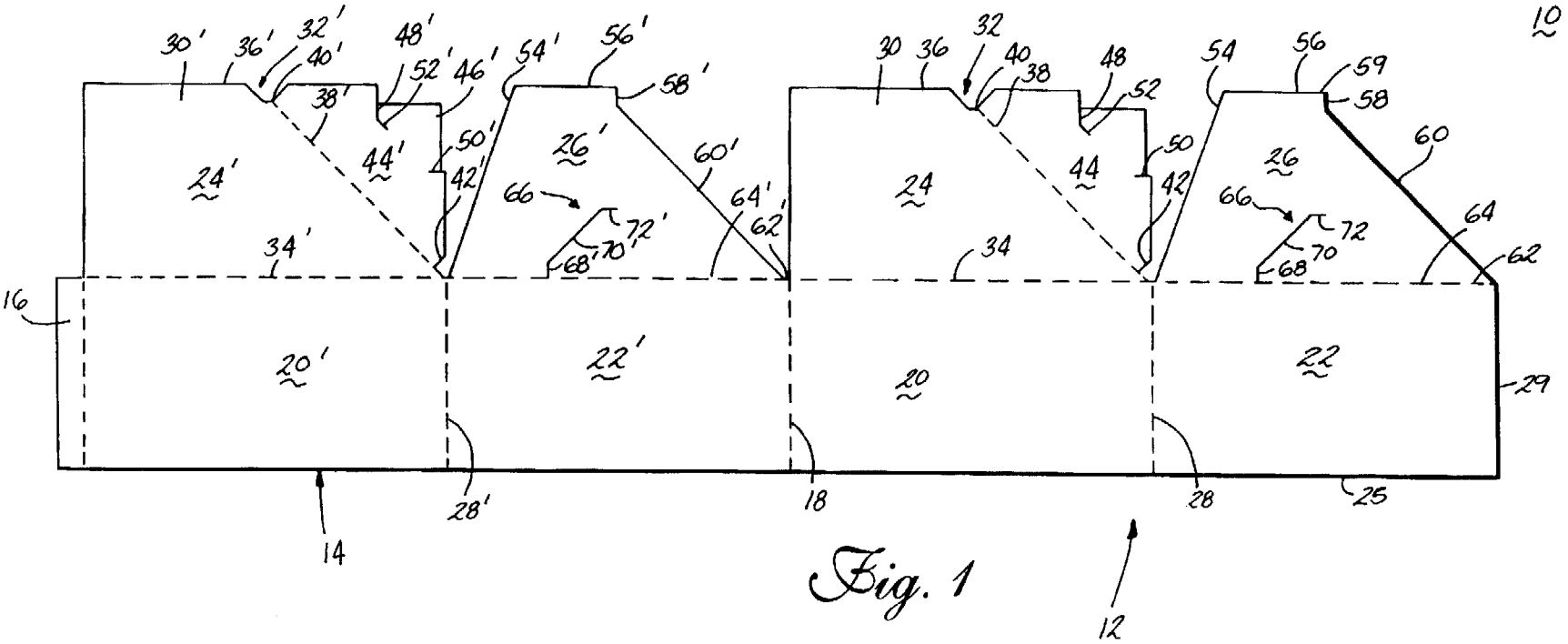
FIG. 1 is a top plan view of the collapsible box blank according to the invention.

Turning now in particular to FIG. 1, a collapsible box blank according to the invention is shown generally at 10. The blank is formed of a corrugated fiberboard material and comprises a right half portion 12, a left half portion 14 with a tab 16 extending laterally outwardly from the lower half of the left half portion 14. The solid lines on blank 10 represent edges or slots where the blank 10 is cut, while the dotted lines represent scores where the blank 10 will be folded during assembly. As will be apparent later, the final product is a collapsed box having four sidewalls and two pairs of connected flaps, each pair being adapted to interlock with the other pair as the box is expanded from the collapsed position. The right half portion 12 is identical to the left half portion 14 in all salient respects so that only the right half portion 12 will be described, with corresponding elements of the left half portion 14 being referenced by numerals having a prime-symbol suffix (') as shown in the drawings. Right half portion 12 and left half portion 14 are divided by a central scoring line 18.

The right half portion 12 comprises a first sidewall 20, a second sidewall 22, a first floor portion 24, and a second floor portion 26. An edge 25 borders one side of each sidewall. The first and second sidewalls 20, 22 are rectangular in shape, the first sidewall being defined by scoring lines 18, 28, 34 and edge 25. Similarly, the second sidewall 22 is defined by scoring lines 28, 64 and by edges 25, 29.

The first floor portion 24 comprises flap 30 which extends from first sidewall 20 adjacent to the scoring line 34 which is opposite the edge 25. A truncated V-shaped notch 32 having a horizontal base 40 is disposed at approximately the midpoint of an upper edge 36 of the flap 30 opposite the scoring line 34. A scoring line 38 extends from the base 40 of the notch 32 toward a corner 42, at the junction of scoring lines 34, 28, and 64 so as to define a second flap 44 out of a portion of flap 30. Second flap 44 is generally triangular in shape and includes a recessed corner tab 46 defined by orthogonally extending slits 48, 50. Slit 48 also includes an extension slit 52 extending generally parallel to the score line 38.

Second floor portion 26 is a flap extending from the second sidewall 22 adjacent to the scoring line 64 which is opposite the edge 25. The portion 26 is defined by a first upwardly extending diagonal edge 54 which terminates at the first end of an upper edge 56, which is parallel to score line 64. A short edge 58 extends orthogonally toward the score line 64 from the opposite end of edge 56, to define a corner 59. A 45-degree edge 60 extends diagonally from edge 58 toward a corner 62 at the junction of score line 64 and edge 29. A lower central area of second floor portion 26 also includes a slot 66 which comprises a short slit 68 extending normally away from scoring line 64, a longer slit 70 extending from the slit diagonally away from slit 68, and another short slit 72 extending from the slit 70, parallel to the score line 64.

Figure 2:
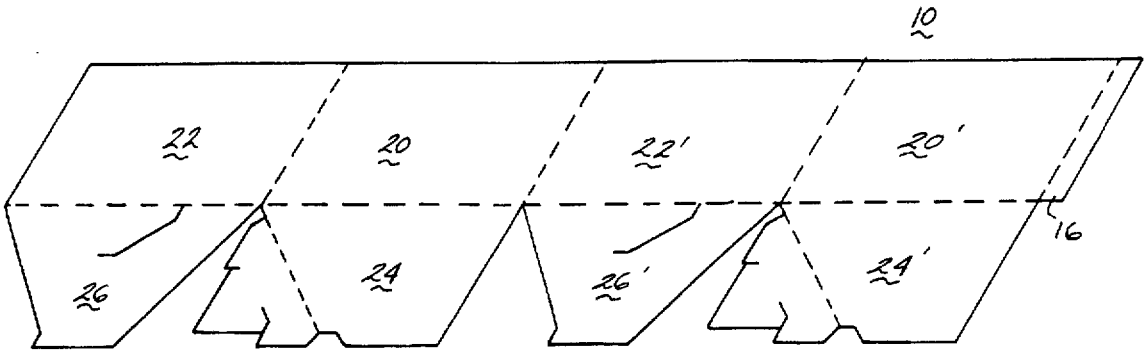
FIG. 2 is a perspective view of the blank of FIG. 1 prior to assembly.
Figure 3:
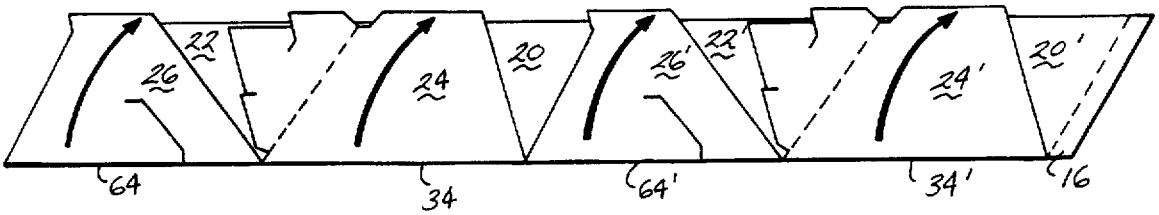
FIG. 3 is a perspective view of the collapsible box blank showing an upward perpendicular fold of the box blank floor portions.

Turning now to FIGS. 2–7, the assembly of the box from the blank 10 is illustrated. The blank 10 is preferably laid on a flat surface with the face of the blank to be the interior of the box facing upward as shown in FIG. 2. Floor portions 24, 26, 24' and 26' are folded upwardly along scoring lines 34, 64, 34' and 64', respectively, as shown in FIG. 3. At this point, the floor portions 24, 26, 24' and 26' are preferably at a 90-degree angle relative to the sidewalls 20, 22, 20' and 22'.

Figure 4:
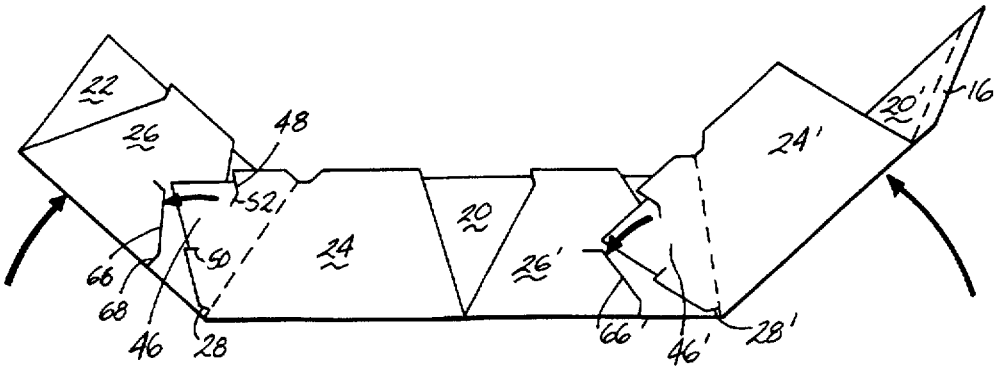
FIG. 4 is a perspective of the construction box blank of FIG. 1 showing the insertion of locking tabs into mating slots on the floor portion to further assemble the collapsible box.
Figure 5:
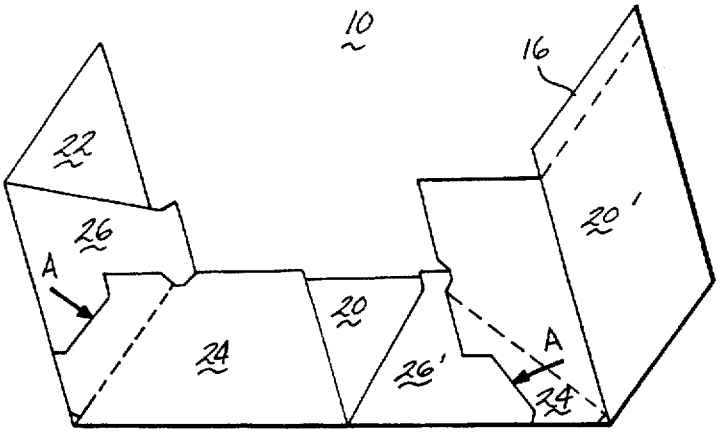
FIG. 5 is a perspective view of the collapsible box of FIG. 1 showing the box assembly after locking tabs have been matingly inserted into slots on the floor portions.

As shown in FIG. 4, sidewall 22 is then folded upwardly along scoring line 28, carrying with it the floor portion 26 until the recessed tab 46 on adjacent floor portion 24 matingly locks with slot 66 on floor portion 26. The locking feature of tab 46 with slot 66 is enhanced by the interaction of the vertical and diagonal slits 48 and 52 on tab 46 with the slit 72 on slot 66, and the interaction of the horizontal slit 50 mating with the vertical slit 68 on slot 66 such that the tab 46 cannot be removed from the slot 66 without manually deforming it. It will be apparent that with this mechanical lock, no glue is required to maintain the engagement of tab 46 with slot 66. A similar step is performed for the remaining sidewalls 20', 22' and floor portions 24', 26' respectively. When these steps are completed, the semi-assembled blank 10 will appear as shown in FIG. 5 with the arrows A in the figure noting the locking insertion of tabs 46, 46' with slots 66, 66', respectively.

Figure 6:
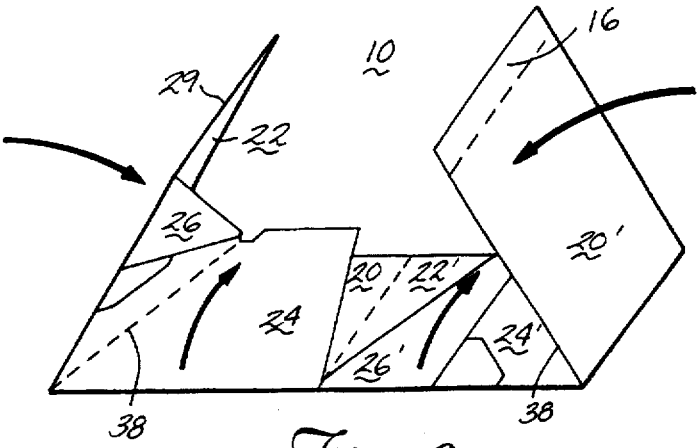
FIG. 6 is a perspective view of the collapsible box of FIG. 1 showing an inward folding of the box along 45° scoring lines in the floor portions.

As shown in FIG. 6, floor portions 24 and 26 are then folded inwardly along the scoring line 38 in a 45-degree accordion fold drawing the sidewall 20 over the adjacent sidewall 20 with the interlocked floor portions 24, 26 sandwiched between them. A similar step is performed for the other side of the box.

Figure 7:
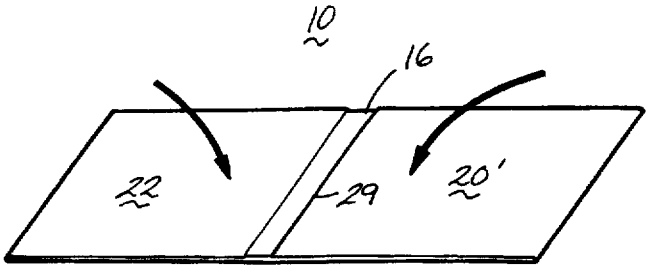
FIG. 7 is a perspective view of the collapsible box of FIG. 1 showing the collapsible box assembly after it has been completely collapsed and glued along a central seam.

As shown in FIG. 7, when the prior folding operation is complete, the blank 10 appears as a flattened rectangle with only the exterior surfaces of sidewalls 20' and 22 visible and the laterally extending tab 16 resting over the edge 29 of sidewall 22 and against the adjacent surface. The laterally extending tab 16 is then affixed to the adjacent surface of sidewall 22 by, for example, gluing, stitching, or stapling.

At this point, the pre-distribution manufacturing steps are complete. The collapsible nature of this box provides a distinct advantage in that several collapsible box blanks may be stored in their flattened state as shown in FIG. 7 and expanded individually as required.

Figure 8:
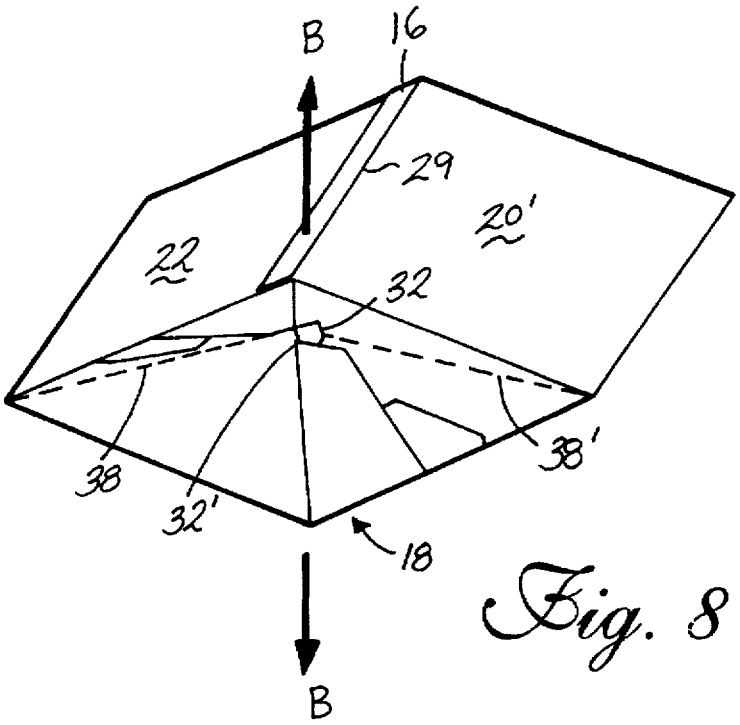
FIG. 8 is a perspective view of the collapsible box assembly of FIG. 1 showing the expansion of the box assembly and the interlocking of the floor portions.
Figure 9:
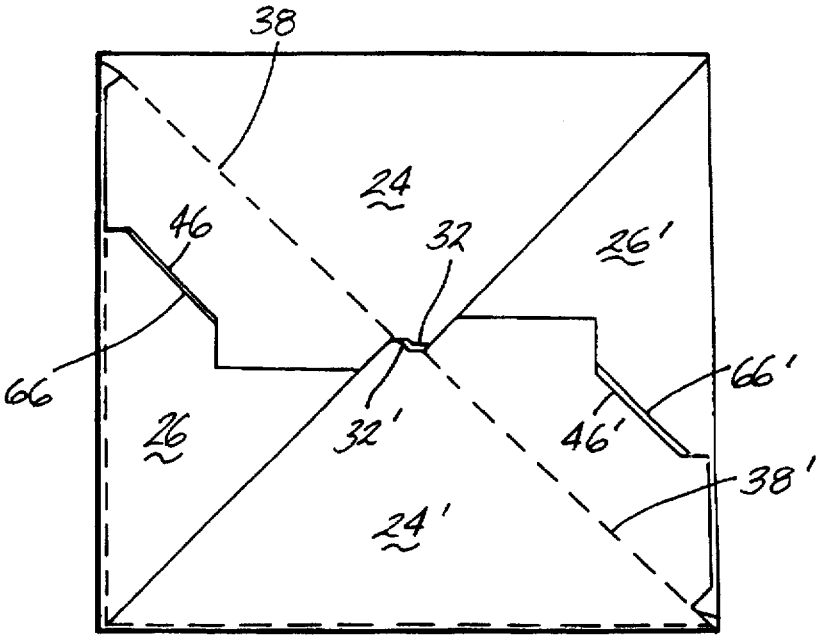
FIG. 9 is a bottom plan view of the erected box assembly showing the interlocking floor portions in greater detail.

Turning to FIGS. 8–9, the expansion of the blank 10 from its folded state to an erected structure having four vertical walls and an interlocking floor is shown. The blank 10 may be grasped at the edge 29 and along the scoring line 18 disposed along the opposite side of the assembled blank 10. As shown in FIG. 8, the edge 29 and scored line 18 are pulled in directions denoted by the arrows B. This motion urges the scoring lines 38 and 38' to return to an unfolded position such that flap 30 of floor portion 24 slides underneath floor portion 26', and flap 30' of floor portion 24' slides underneath floor portion 26. As the floor portions approach the same plane, notches 32, 32' automatically meet and interlock at the central portion of the box blank floor as shown in FIG. 9.

It will be apparent that all of the foregoing operations can be automated and performed by a machine so that the folding steps of FIGS. 4 and 6 can be accomplished simultaneously.

Reasonable variation and modification are possible within the spirit of the foregoing specification and drawings without departing from the scope of the invention.

The embodiments for which an exclusive property or privilege is claimed are defined as follows:

1. A blank adapted to form a rectangular box with an interlocked base comprising:
   - four side panels hinged together in series, a panel at one end of the series having a side flap for mounting to a panel at an opposite end of the series, said side panels sharing a common edge;
   - four bottom panels, each bottom panel hinged to a corresponding side panel along the common edge, the four bottom panels comprising
     - two first bottom panels and two second bottom panels, the first and second bottom panels disposed in an alternating arrangement;
     - each of the first bottom panels having a bottom flap which includes a corner adjacent a second bottom panel and having a tab thereon;
     - a notch extending inwardly from an outer edge of each of the first bottom panels; and
     - each of the second bottom panels having an outer edge and slot adjacent to and extending away from the common edge adapted to lockingly receive the tab on an adjacent first bottom panel;
   - whereby when the side flap is mounted to the panel at the opposite end of the series and the tab on each first bottom panel is received within the slot on the adjacent second bottom panel, the blank forms a box which is selectively movable between a collapsed position wherein the bottom panels are folded inwardly between two series of side panels in a flat arrangement and an erected position wherein the outer edge of each second bottom panel is received in a notch to form an interlocked base.

2. The blank of claim 1 wherein the notch of each of the first bottom panels is V-shaped.

3. The blank of claim 1 wherein the four side panels are of equal shape and size.

4. The blank of claim 1 wherein the bottom flap of each of the first bottom panels is in the shape of a triangle wherein an edge of the triangle forms a hinged connection to a remaining portion of each of the first bottom panels.

5. The blank of claim 1 wherein the tab on each of the first bottom panels and the slot on each second bottom panel include locking means to secure the engagement between them.

6. The blank of claim 5 wherein the locking means on the tab comprises at least one slot which extends inwardly from the bottom flap.

7. The blank of claim 5 wherein the locking means on the slot comprises a slit disposed at each terminal end of the slot extending at an obtuse angle therefrom.

8. A pre-assembled carton, the carton being selectively moveable between a collapsed position, wherein the carton is storable as a flat component in a stacked fashion, and an erected position, adapted to form a container having four sidewalls and an interlocked base, comprising:

four side panels hinged together in series and sharing a common edge;

four bottom panels, each bottom panel hinged to a corresponding side panel along the common edge, the four bottom panels comprising:

two first bottom panels and two second bottom panels, the first and second bottom panels disposed in an alternating arrangement;

each of the first bottom panels having a bottom flap thereon which includes a corner adjacent a second bottom panel and having a tab thereon;

a notch extending inwardly from an outer edge of each of the first bottom panels; and each of the second bottom panels having an outer edge and slot adjacent to and extending away from the common edge adapted to lockingly receive the tab on an adjacent first bottom panel;

whereby when the tab on each first bottom panel is received within the slot on the adjacent second bottom panel, the preassembled carton is selectively movable between a collapsed position wherein the bottom panels are folded inwardly between two series of side panels in a flat arrangement and an erected position wherein the outer edge of each second bottom panel is received in a notch to form an interlocked base.

* * * * *